US005490599A

United States Patent [19]

Tohidi

[11] Patent Number: 5,490,599

[45] Date of Patent: Feb. 13, 1996

[54] LONG MULTI-POSITION MICROPHONE SUPPORT STAND

[76] Inventor: Fred F. Tohidi, 10045 Montecito Plz., Garden Grove, Calif. 92640

[21] Appl. No.: 363,683

[22] Filed: Dec. 23, 1994

[51] Int. Cl.[6] ..... A47F 7/00

[52] U.S. Cl. ..... 211/171; 211/205; 248/158; 248/121

[58] Field of Search ..... 211/205, 196, 211/171, 164, 203, 204; 248/158, 431, 171, 185, 187, 121, 124, 125, 177

[56] References Cited

U.S. PATENT DOCUMENTS

| | | | |
|---|---|---|---|
| 1,437,579 | 12/1922 | Wilson | 248/185 X |
| 2,303,978 | 12/1942 | Biberman | 248/171 |
| 2,418,067 | 3/1947 | Carpenter | 248/121 X |
| 2,532,173 | 11/1950 | Lewis | 248/124 |
| 2,615,662 | 10/1952 | Sannebeck | 248/124 |
| 2,652,220 | 9/1953 | Nocht | 248/187 |
| 3,223,826 | 12/1965 | Malcuso | 248/124 X |
| 3,415,475 | 12/1968 | Goodman | 248/158 |
| 4,703,506 | 10/1987 | Sakamoto et al. | 381/92 |
| 4,889,303 | 12/1989 | Wolf | 248/160 |
| 5,048,789 | 9/1991 | Eason et al. | 248/544 |
| 5,058,170 | 10/1991 | Kanamori et al. | 381/92 |

*Primary Examiner*—Robert W. Gibson, Jr.
*Attorney, Agent, or Firm*—Sandra M. Parker

[57] ABSTRACT

A microphone stand assembly incorporating an adjustable height and angle microphone support column to be securely oriented in a plurality of positions is provided. In the preferred embodiment the column accommodates six microphones. This arrangement permits performers to utilize a single microphone stand with six microphones at different heights for simultaneous voice and musical instrument amplification. In addition, the invention provides a means for adjustably retaining a set of microphones in a preselected position, usable in a horizontal position, vertical position or in any other angle, allowing for a change in the position of a microphone support column and for accommodation of more than one microphone housing slot mounted on a single microphone support stand assembly. The result is an apparatus, relatively inexpensive and compact, with possibility of use by people of different heights without adjusting the stand or the microphone.

20 Claims, 3 Drawing Sheets

LONG MULTI-POSITION MICROPHONE SUPPORT STAND

BACKGROUND OF THE INVENTION

1. Field of the Invention

The present invention relates generally to the field of microphone support stand assembly. In particular, this invention relates to a long multi-position microphone support stand, allowing for a change in the position of a microphone support column and for accommodation of more than one microphone housing slot. The result is a possibility of use by people of different heights with different instruments, without adjusting the stand or the microphone, and the ability of use by several people and/or instruments simultaneously or one at the time.

2. Brief Description of the Prior Art

Microphone support stand must be positioned in proximity of the performer's mouth. Therefore, the microphone's height has to be adjustable because it is used by a plurality of speakers whose physical height is disparate. Moreover, oftentimes, the need exists to provide microphone support for several performers simultaneously.

Two independent microphone stands are necessary when a singer-musician requires two microphones, a first positioned proximate to his mouth and a second positioned proximate to his instrument. Musicians who play several instruments at the same time, like a guitar and a harmonica, also need two or more microphones simultaneously. A group of singers and/or musicians need several microphones simultaneously.

The conventional adjustable microphone stand includes an elongated metal microphone support column. The column can be adjusted to move in various preselected orientations. However, this adjustment is not precise, takes time and creates high pitch noise that the microphone will pick up, amplify it and transmit over the loud speakers. Moreover, each performer and/or instrument requires a separate microphone and such equipment is bulky and complicated hardware not very practical for transport.

Prior art microphone stands that allow positioning usually provide pivotal movement at the position where a microphone is coupled to a microphone support stand, or at the position where a microphone support column member supports the microphone and is pivotally joined to the microphone support column.

Most existing microphone support stands are adjustable as to height. For example, many support stands include a telescoping upright member. A lock or latch means is used to hold the uppermost portion of the telescoping upright member in a desired position. Another type of telescoping microphone stand utilizes a tilting disk at the bottom of the vertically adjustable section of the microphone support stand. The tilting disk is designed to prevent the adjustable section from being pulled downward by gravity but it does not restrict upward movement of such section. A movable knob at the upper end of the stand is designed to tilt and release the disk to allow downward movement of the adjustable section.

Several microphone stands from prior art utilize a plurality of microphones housing slots. For example, Wolf, U.S. Pat. No. 4,889,303, describes a flexible, manually bendable housing having a plurality of openings for microphones. However, all the microphone slots are positioned one above the other.

Kanamori, U.S. Pat. No. 5,058,170, describes plurality of microphones arranged linearly at equal intervals. However, this invention is related to the apparatus in which all the outputs from all microphones are summed up in an adder circuit to form an audio signal. The present invention describes a microphone stand with different design and without the adder circuit.

Sakamoto, U.S. Pat. No. 4,703,506, describes a device with at least three sets of microphone units. However, this is a directional microphone apparatus wherein the simultaneously picked up output signals from all the microphones are summed up and filtered to produce the optimum sound from these different portions of the sound. The present invention describes a microphone stand with completely different design and without the summing and filtering circuits.

Eason, U.S. Pat. No. 5,048,789, describes a stackable microphone stand, containing several parts, each with its own microphone, positioned one above the other. The feature of stackability does not exist in the present invention and the microphones can be at angle to one another.

In all the inventions described as prior art, the speaker has to keep his head centered with respect with the microphone and, therefore, his motion is limited in hands-free audio systems, requiring manual selection of any one of the single microphone stands and microphone heights during the live performance. It is evident that these systems are less than ideal from the standpoint of ease of operation and convenience.

SUMMARY OF THE INVENTION

There clearly exists a need for a long multi-position microphone support stand which provides a means for adjustably retaining a set of microphones in a preselected position, usable in a horizontal position, vertical position or in any other angle, allowing for a change in the position of a microphone support column and for accommodation of more than one microphone housing slot. The result is a possibility of use by people of different heights or with different instruments without adjusting the stand or the microphone-, and the ability of use by several people simultaneously or one at the time.

Moreover, it is desirable to provide a stable multi-positionable microphone support stand assembly with adjustable microphone support column that permits more than one microphone to be used simultaneously and where a plurality of microphones is mounted on a single microphone support stand assembly.

The microphone support stand assembly of the present invention offers two important advantages in that it places microphones close to all performers and/all instruments and it avoids the loss of sound that might otherwise occur.

Accordingly, it is an object of the present invention to provide an improved multi-positionable microphone support stand assembly, with a microphone support column usable in a horizontal position, vertical position or in any other angle.

A further object of the instant invention is to provide an improved multi-positionable microphone stand assembly wherein the orientation of the microphone support column is established at the top of the microphone support stand or at another position along the microphone support stand.

Another object of the invention is to provide an improved microphone stand assembly for accommodation of more than one microphone housing slot, capable of supporting a plurality of microphones.

Still another object of the invention is to provide an improved microphone stand assembly for accommodation of more than one microphone housing slot, with the ability of use by several performers simultaneously.

Yet another object of the invention is to provide an improved microphone stand assembly, capable of supporting a plurality of microphones, mounted on a single microphone support stand assembly.

Still another object of the invention is to provide an improved microphone stand assembly with possibility of use by people of different heights or with different instruments, without adjusting the stand or the microphone.

Yet another object of the invention is to provide a highly stable stand assembly which occupies minimum space.

The advantage of the microphone stand assembly developed in the present invention is that the additional microphone stands for additional musicians and/or musical instruments, required by prior art schemes, are not needed.

Another advantage of the microphone stand assembly developed in the present invention is that the additional and complicated electrical and mechanical apparati, described by prior art, are not needed for this microphone stand assembly.

The apparatus developed in the present invention solves the problems of constant adjustment encountered in microphone stand assemblies presently utilized and provides an inexpensive tool for providing simultaneous pick up of sounds sufficient for an average musician or a group.

In the preferred embodiment, a microphone stand assembly is presented for enhanced entertainment at an economical manner. In accordance with the invention, a microphone support stand accommodating at least one microphone support column in plurality of orientations is provided. The multi-position microphone support stand assembly for allowing a set of microphones to be securely oriented in a plurality of heights and angles, is comprising: a microphone support stand; a microphone support column including a plurality of microphone housing slots, rotably mounted on said microphone support stand; and a locking means for selectively and releasably securing and positioning said microphone support column at a predetermined orientation, wherein said microphone support stand includes at least one opening therein for receiving the locking means.

The microphone support stand comprises a plurality of microphone support stand openings with threaded sleeves in several places along the microphone support stand. The microphone housing slots are in a fixed or variable relationship relative to one another. The locking means is centrally positioned on the microphone support column. In the preferred embodiment, the microphone support column comprises an even number of microphone housing slots linearly arranged at equal intervals.

In another embodiment of the microphone support stand assembly, including the same microphone support stand supporting the microphone support column, the single base supporting the microphone support stand is replaced with a tripod.

DESCRIPTION OF THE DRAWINGS

The features of the present invention can be best understood together with further objectives and advantages by reference to the following description, taken in connection with the accompanying drawings, wherein like numerals indicate like parts.

DESCRIPTION OF THE INVENTION

In the following description, numerous specific details are set forth in order to provide a more thorough description of the invention. It will be apparent, however, that the present invention may be practiced without these specific details. In other instances, well known features have not been described in detail so as not to unnecessarily obscure the present invention.

Figure 1:
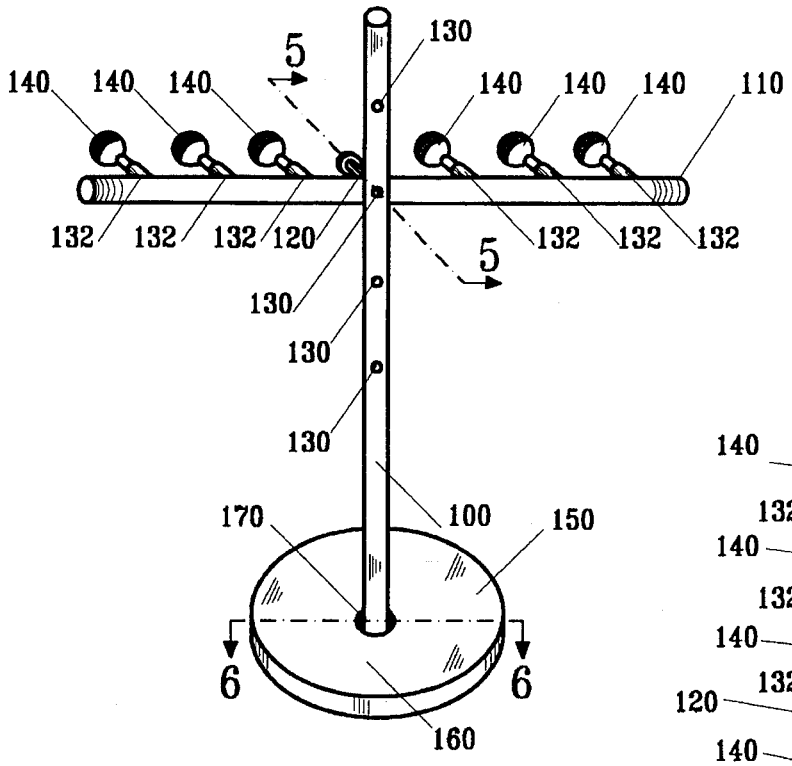
FIG. 1 is an elevational view of an illustrative embodiment of a long multi-positioning microphone stand assembly depicting the positioning of a microphone column in a horizontal orientation, in accordance with the present invention.
Figure 2:
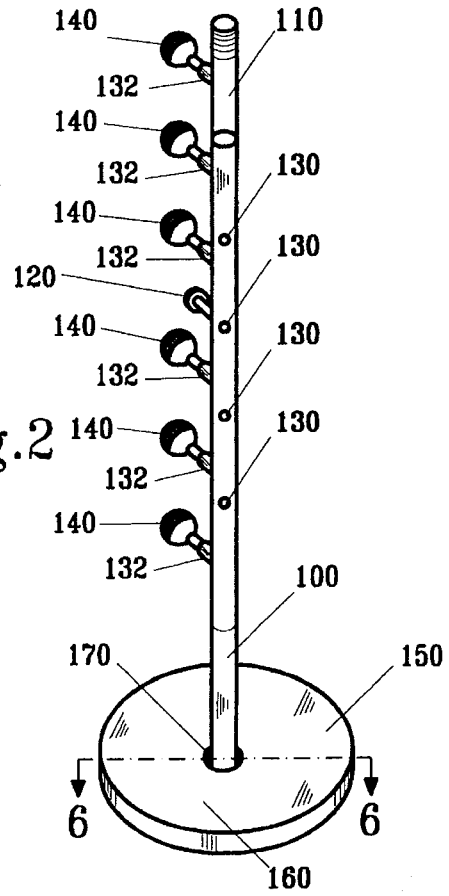
FIG. 2 is an elevational view of the long multi-positioning microphone stand assembly of FIG. 1, depicting the positioning of the microphone column in a vertical orientation, in accordance with the present invention.
Figure 3:
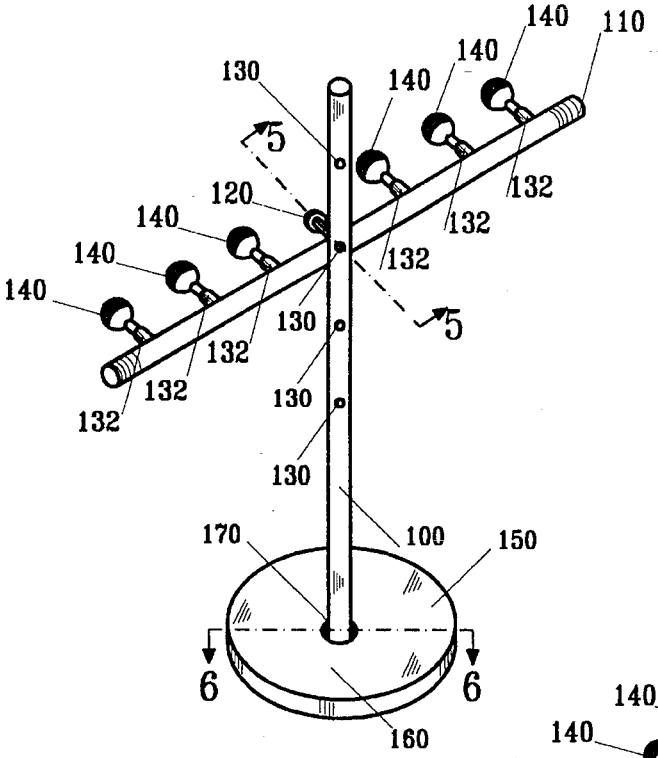
FIG. 3 is an elevational view of the long multi-positioning microphone stand assembly of FIG. 1, depicting the positioning of the microphone column in a rotated position, in accordance with the present invention.

A microphone stand assembly for allowing a microphone support column to be securely oriented in a plurality of positions is provided in this invention. The preferred embodiment of the invention will be described in conjunction with the drawings. Referring now to FIG. 1, a microphone support stand assembly is illustrated. FIGS. 2–3 illustrate the preferred embodiment of the invention from FIG. 1, in which the angles of the microphone support column are changed in the arrangement, while the other components remain unchanged.

In accordance with one embodiment of the present invention, shown in FIG. 1, a microphone support stand 100 with a single base 150 is presented, capable of supporting a microphone support column 110 in various positions and providing simultaneous usage of several microphones 140. The microphone support stand 100 supports the microphone support column 110, having a plurality of microphone housing slots 132, which in turn support a set with a plurality of the microphones 140. The microphone support column 110 can be rotably mounted on the microphone support stand 100 so that the microphones 140 can be securely oriented in a plurality of heights and angles. The base 150 is preferably formed of cast iron and includes a circular or oval shaped base plate 160 with a threaded base hole 170, for receiving the microphone support stand 100.

The microphone support stand 100 is secured at the base 150 by first being positioned in the base hole 170, in a desired orientation and then by fixedly attaching the microphone support stand 100 into the base hole 170. Any other type of engagement means can be provided on the base 150 and the microphone support stand 100 to facilitate detachable connection of the base 150 and microphone support stand 100, if desired. This arrangement enables the microphone support stand assembly to be separated and folded for transport without total and complicated disassembly.

A locking means for selectively and releasably securing and positioning said microphone support column 110 is a fastener 120, in preferred embodiment represented as a locking bolt, which secures the microphone support column 110 in various orientations. At least one opening for receiving said locking means is included in the microphone support stand 100. In the preferred embodiment, a threaded sleeve 190, is formed at the top of the microphone support stand 100 in a microphone support stand opening 130, for receiving the fastener 120. The microphone support column 110 is releasably secured in the threaded sleeve 190, by the fastener 120, through a microphone support column opening 115, The number and form of fastening means can vary, and they do not have to be screws or locking bolts. In the preferred embodiment, the fastener 120 is centrally positioned on the surface of the microphone support column 110 through an aperture on the microphone support stand 100. A sheet metal screw, not shown, may be inserted to securely attach the microphone support column 110 to the microphone support stand 100 or a movable knob representing the fastener 120 in FIG. 1–5 can be used, adapted to releasably lock and designed to tilt and release the microphone support column 110 and to allow downward movement in the adjustable manner.

The microphone support column 110 includes a plurality of equidistant or variously spaced microphone housing slots 132 whose height is switchably selected in advance, by manual arrangement. The microphone housing slots 132 can be in a fixed or in a variable relationship relative to one another. In the preferred embodiment, shown in FIG. 1, an even number of the microphone housing slots 132 are arranged linearly at equal intervals, comprising a row of microphones 140 along the microphone stand column 110. In the preferred embodiment, the microphone support column 110 accommodates six microphones 140 in six microphone housing slots 132. This arrangement permits a performer or a group to utilize a single microphone support stand 100 with six microphones 140 at different heights for simultaneous voice and musical instrument amplification. However the invention is not limited to such an orientation.

The length of the microphone support column 110 may be 6 feet, with the microphone housing slots 132 at the respective distance of 1, 2 and 3 feet on each side from the microphone support stand opening 130. Other variants are possible without departing from the scope of this invention, thereby permitting the plurality of microphones 140 to be arranged at intervals varying from 6 to 12 inches. The microphone support stand 100 may be six feet tall.

The orientation of the microphones 140 is selected by bringing the microphone support stand 100 and the microphone support column 110 into an alignment and with a desired orientation. The microphone support column 110 is placed in front of the microphone support stand 100, the fastener 120 is then placed through the aligned microphone support stand opening 130, and the microphone support column opening 115 and thereafter the fastener 120 is tightened. The microphone support column 110 angle ranges from 0 to 90 degrees.

In the exemplary embodiment shown in FIG. 1, the microphone support column 110 is disposed in a horizontal position. In FIG. 2, the microphone column 110 is disposed in a vertical position. In FIG. 3, the microphone support column 110 is at an angle to the base 150 and the microphone support stand 100, and directed toward the performer, not shown. It is apparent that the microphone support column 110 can be adjusted into any number of angular positions by increasing the angle of the microphone support column 110 and that the angle can be selectively varied.

When the microphone support column 110 is in a slanted or in a horizontal position, the microphone support stand 100 can be simultaneously used by several performers. When the microphone support column 110 is in a vertical position, it can be used by a performer simultaneously singing and using one musical instrument or using several musical instruments at the same time.

In the preferred embodiment of the present invention, the microphone support stand 100 and the microphone support column 110 are tubular hollow channels with a smooth exterior surface fabricated of a solid material like metal or polyvinyl chloride, nylon or other synthetic material.

Although it is indicated in FIGS. 1–4 that the microphone support column 110 is attached to the opening 130 at the upper end of the microphone support stand 100, a plurality of microphone support stand openings 130 with threaded sleeves 190 can be utilized in several places along the microphone support stand 100, in order to accommodate yet another set of microphone 140 positions and heights.

The microphone housing slot 132 means for housing the microphones 140 are well known in the art and do not need to be described here or be shown in detail. They may comprise any mechanism desired and any model of microphone housing slot 132 and microphone 140 can be utilized in this invention. In one illustration of the preferred embodiment, the microphone housing slots 132 are fixedly mounted and supported on the microphone support column 110. It might be desirable that the microphone housing slots 132 be adjustable and rotably positioned on the microphone support column 110, which causes the microphones 140 to revolve.

Figure 4:
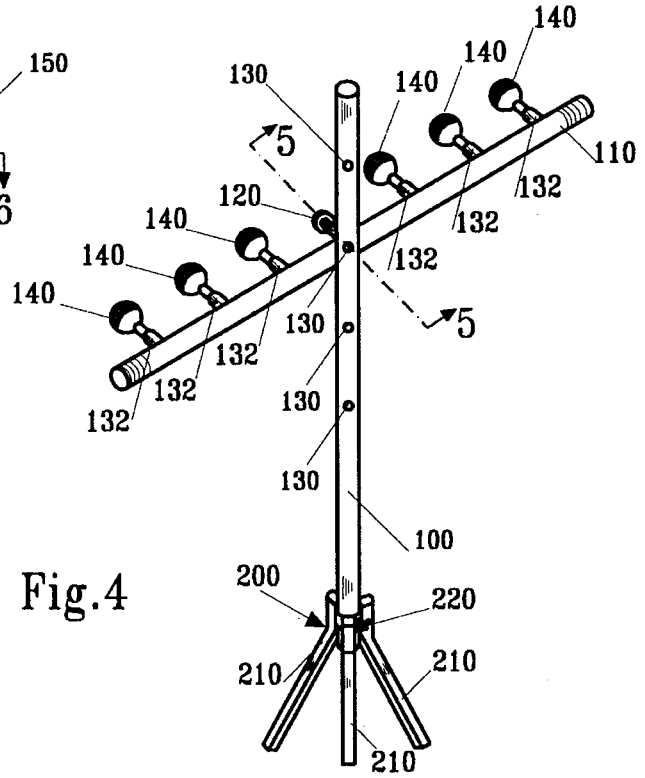
FIG. 4 is an elevational view of an illustrative embodiment of a long multi-positioning microphone stand assembly of FIG. 1 depicting the base supporting the microphone stand shaped as a tripod, in accordance with another embodiment of the present invention.
Figure 5:
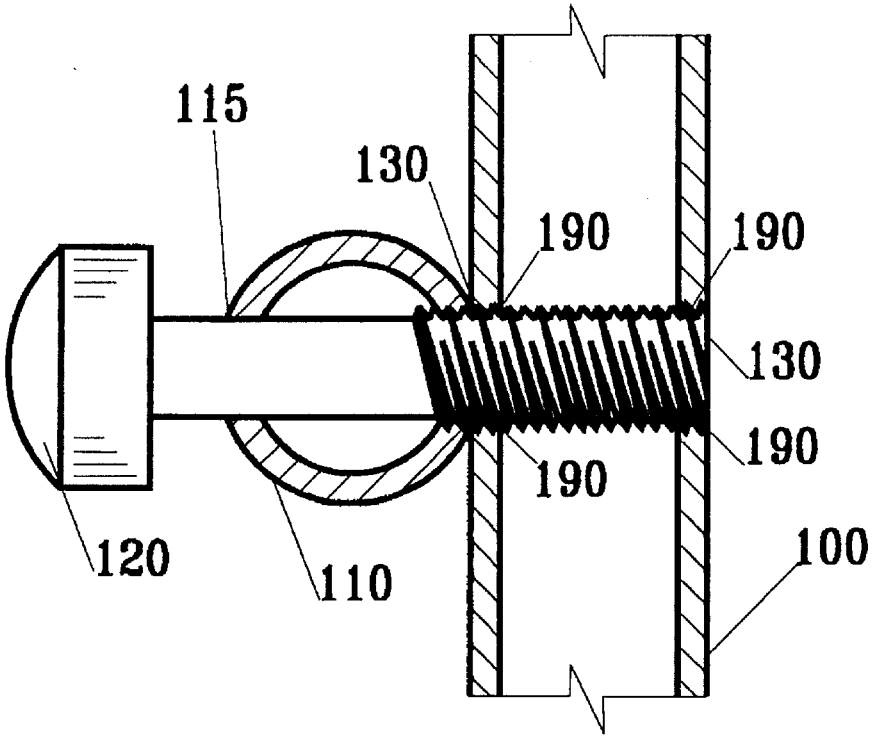
FIG. 5 is a cross-sectional view of the locking means taken along line 5—5 of FIGS. 1, 3 and 4.
Figure 6:
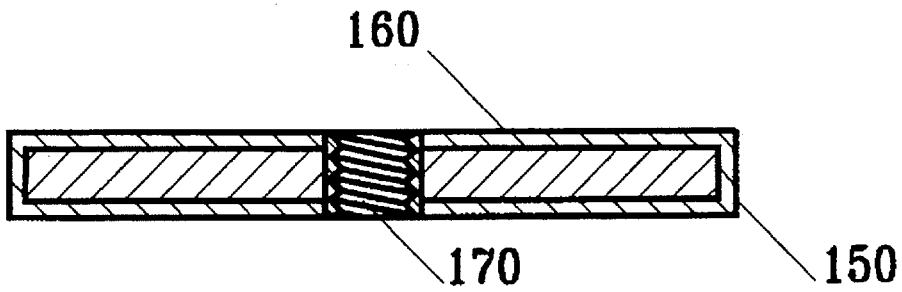
FIG. 6 is a cross-sectional view of the base 150 taken along line 6—6 of FIGS. 1–3.

FIG. 4 illustrates another embodiment of the microphone support stand assembly including the same microphone support stand 100, supporting the microphone support column 110, as shown in FIG. 1, but the single base 150 supporting the microphone support stand 100 is replaced with a tripod 200. The tripod 200 is a foldable steel tripod 200 whose legs 210 fold or collapse downwardly. The tripod 200 is releasably secured to the microphone support stand 100, with a locking means, for example, with a wing nut which may be loosened, thereby allowing the folded tripod 200 to slide upwardly along the microphone support stand 100. Thus, the tripod 200 is a separate unit which must be securely fastened to the microphone support stand 100 in order to support the stand 100 in a stable manner. This allows for easy packing for storage and transport, without much disassembly. A cross-sectional view of the locking means shown through the fastener 120 is shown in FIG. 5 and a cross-sectional view of the base 150 is shown in FIG. 6.

While the proffered embodiments have been described and illustrated, various modifications and substitutions may be made thereto without departing from the scope of the invention. Accordingly, it should be understood that the present invention has been described by way of illustration and not limitation.

What is claimed is:

1. A multi position microphone support stand assembly for allowing a set of microphones to be securely oriented in a plurality of heights and angles, comprising:

a microphone support stand having an upper end and a lower end;

a microphone support column including a plurality of microphone housing slots, rotably mounted on said microphone support stand; and a locking means for selectively and releasably securing and positioning said microphone support column at a predetermined orientation, wherein said microphone support stand includes at least one opening therein for receiving the locking means.

2. The invention set forth in claim 1 above, wherein said microphone support column is attached to the at least one opening located at the upper end of the microphone support stand.

3. The invention set forth in claim 1 above, wherein said microphone support stand comprises a plurality of microphone support stand openings in several places along the microphone support stand.

4. The invention set forth in claim 1 above, wherein said plurality of microphone housing slots is in a fixed relationship relative to one another.

5. The invention set forth in claim 1 above, wherein said plurality of microphone housing slots is in a variable relationship relative to one another.

6. The invention set forth in claim 1 above, wherein said locking means is centrally positioned on the microphone support column.

7. The invention set forth in claim 6 above, wherein said locking means is a locking bolt.

8. The invention set forth in claim 1 above, wherein said microphone support column comprises an even number of microphone housing slots linearly arranged at equal intervals.

9. The invention set forth in claim 1 above, wherein said microphone support column comprises six microphone housing slots equidistantly or variously arranged at the intervals varying from 6 to 12 inches.

10. The invention set forth in claim 1 above, wherein the microphone support stand and the microphone support column are tubular hollow channels fabricated of a solid material like metal or polyvinyl chloride, nylon or other synthetic material.

11. A multi-position microphone support stand assembly for allowing a set of microphones to be securely oriented in a plurality of heights and angles, comprising:

a microphone support stand having upper and lower ends;

a base secured to the lower end of the microphone support stand, constructed to support the microphone support stand;

a microphone support column including a plurality of microphone housing slots, rotably mounted on said microphone support stand; and a locking means for selectively and releasably securing and positioning said microphone support column at a predetermined orientation, wherein said microphone support stand includes at least one opening therein, said at least one opening being disposed in for permitting said locking means to be inserted through said at least one opening to define a predetermined orientation of said microphone support column.

12. The invention set forth in claim 11 above, wherein said plurality of microphone housing slots is in a fixed relationship relative to one another.

13. The invention set forth in claim 11 above, wherein said plurality of microphone housing slots is in a variable relationship relative to one another.

14. The invention set forth in claim 11 above, wherein said locking means is centrally positioned on the microphone support column.

15. The invention set forth in claim 14 above, wherein said locking means is a locking bolt.

16. The invention set forth in claim 11 above, wherein said microphone support column comprises an even number of microphone housing slots linearly arranged at equal intervals.

17. The invention set forth in claim 11 above, wherein said microphone support column comprises six microphone housing slots equidistantly or variously arranged at the intervals varying from 6 to 12 inches.

18. The invention set forth in claim 11 above, wherein the microphone support stand and the microphone support column are tubular hollow channels fabricated of a solid material like metal or polyvinyl chloride, nylon or other synthetic material.

19. The invention set forth in claim 11 above, wherein the base includes a circular or oval shaped base plate with a base hole for receiving the microphone support stand.

20. The invention set forth in claim 11 above, wherein the base is comprising a plurality of leg members attached to the microphone support stand by a locking means.

* * * * *